US005205690A

United States Patent [19]

Roth

[11] Patent Number: 5,205,690

[45] Date of Patent: Apr. 27, 1993

[54] CONCRETE INSERT FOR ATTACHING UTILITY HANGERS TO A STRUCTURE

[76] Inventor: Steven Roth, 2891 Danville Blvd., Alamo, Calif. 94507

[21] Appl. No.: 856,364

[22] Filed: Mar. 23, 1992

[51] Int. Cl.[5] ..... F16B 39/02; E04B 1/38; E04C 5/00

[52] U.S. Cl. ..... 411/82; 411/180; 411/930; 52/704; 52/707

[58] Field of Search ..... 411/82, 180, 258, 930; 52/699, 701, 704, 705, 706, 707

[56] References Cited

U.S. PATENT DOCUMENTS

| | | | |
|---|---|---|---|
| 1,088,290 | 2/1914 | McAllister et al. | 52/707 X |
| 3,405,497 | 10/1968 | McNair | 52/699 |
| 4,325,178 | 4/1982 | Pruehs | 411/180 |
| 4,854,086 | 8/1989 | Kubsh et al. | 411/180 |

FOREIGN PATENT DOCUMENTS

| | | | |
|---|---|---|---|
| 1132793 | 11/1956 | France | 52/707 |

OTHER PUBLICATIONS

Kin-Line, Inc. catalog, 1986, cover page and p. 89.

*Primary Examiner*—Neill R. Wilson
*Attorney, Agent, or Firm*—Glen R. Grunewald

[57] ABSTRACT

A concrete insert having a U-shaped part with two legs and a bridge between them, the bridge having a hole in which an internally threaded coupling is engaged with a friction fit, a bolt threaded in the coupling to extend above the bridge so that the position of the coupling with respect to the U-shaped element can be set by tapping the bolt and held by friction against the side of the hole in the bridge.

6 Claims, 2 Drawing Sheets

CONCRETE INSERT FOR ATTACHING UTILITY HANGERS TO A STRUCTURE

TECHNICAL FIELD

This invention is in the field of inserts for concrete construction, the inserts being useful for attaching items to concrete after it hardens.

BACKGROUND ART

Concrete inserts are used to connect items to concrete structures after the concrete has been poured and hardened. A typical use of an insert is to embed it in a concrete ceiling so that a pipe hanger or the like may be connected to the ceiling via the insert after the concrete hardens. The following description will discuss inserts embedded in ceilings although inserts may be embedded in concrete floors or walls.

Some prior art inserts are U-shaped sheet metal pieces with legs terminating in flanges that lie in a common plane and with a bridge between the legs having a hole in it through which a threaded fastener is inserted. An internally threaded coupling is positioned between the legs of the U-shaped piece to butt against the bridge and a threaded fastener is screwed into the internal threaded cavity of the coupling and locked in place with a nut that abuts the bridge. The prior art concrete inserts are usually made so that the threaded coupling is the same length as the legs of the U-shaped piece whereby when the insert is nailed to a wooden form for concrete and after the concrete hardens and the form is removed, the opening to the threaded coupling is in the plane of the concrete ceiling and the open end of the coupling is exposed after which a threaded rod may be placed in the open end of the coupling and an element such as a pipe hanger can be fixed to the ceiling by connecting it to the rod. Inserts of this nature are known, for example, those illustrated as item 276 on page 89 of the 1986 catalog published by KIN-LINE, INC. located at 6425 San Leandro Street, Oakland, Calif. 94614.

Many concrete floors and ceilings are formed using metal plate or decking as the concrete form. When metal decking is used as a form it is not stripped from the concrete slab after the concrete sets. Rather, it becomes part of the structure and as a consequence inserts do not extend to be flush with the bottom surface of the ceiling formed by the metal decking. To use the above-noted prior art inserts on a ceiling having metal decking requires expensive and time-consuming adjustments of the position of the coupling viz a viz holes punched in the metal decking, and further requires a coupling having a different length from those used with wooden forms to accommodate extending through the thickness of the decking. As a consequence, a contractor must maintain a supply of inserts for metal forms and for plywood forms, and different inserts for each thickness of metal form.

SUMMARY OF THE INVENTION

This invention is an improved concrete insert which is easy to install, which is readily adjustable to be used with any form and easily moved into its desired position in metal deck plate concrete forms of different thickness where it is held firmly to withstand a concrete pour without being moved out of its desired position. When the concrete hardens the insert is fixed firmly and permanently in place and may be used for attachment of various items to hold them firmly to the concrete slab or to hang from the concrete slab.

The insert of this invention is a U-shaped piece characteristically made of bent sheet metal having the general shape of devices of the prior art cited above. In the device of this invention the bridge between the legs of the U-shaped element contains a hole or an opening through which an internally threaded coupling extends. The coupling is preferably at least as long as the legs and is preferably made with flat faces to have a polygonal, usually hexagonal, cross-section. The hole in the bridge of the U-shaped member and the outer face or faces of the coupling are dimensioned so that the coupling is in frictional contact with the hole when the coupling is placed in the hole. The friction is sufficient to resist movement between the bridge and the coupling unless a force greater than gravity is exerted. Preferably, the friction requires gentle tapping with a hammer to move the coupling through the hole. When concrete is poured around the insert of this invention and it hardens, the insert is firmly embedded in the concrete and neither the U-shaped element nor the coupling can move up, down or rotationally.

Although this invention is disclosed with threaded elements, it is evident that functional equivalents to those elements are within the scope of the invention. The coupling may have an internal configuration other than threads to connect it to a rod or other means to suspend pipes, or the like, from a ceiling. The bolt used to position the coupling with respect to the U-shaped support may include any means for connecting to the coupling, including means such as welding that permanently fasten it to the coupling. The position adjusting means may be a sliding collar with a set screw, for example, because that element is only required to be effective while concrete is poured so a durable position adjustment is not required.

DETAILED DESCRIPTION OF THE DRAWINGS

Figure 1:
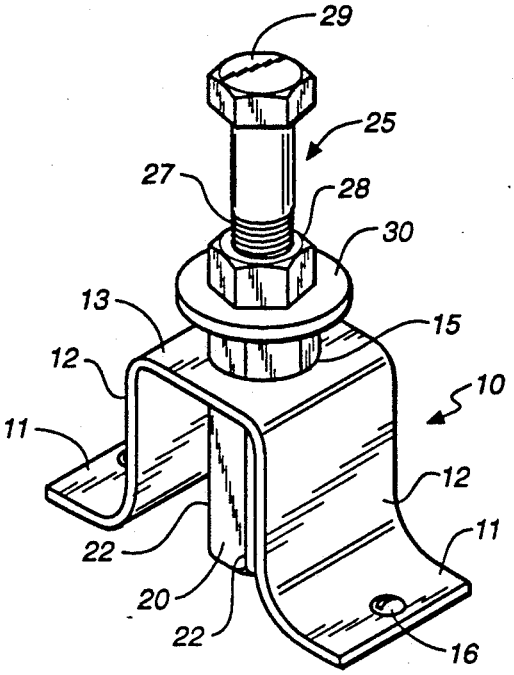
FIG. 1 is a perspective view of a concrete insert embodying this invention with its elements adjusted for installation.

The drawings all illustrate the same device embodying the invention. The illustrated device comprises a U-shaped piece generally designated 10 which consists of upstanding legs 12 terminating in foot-like members 11 which lie substantially in the same plane. The upstanding legs 12 are connected to one another with a bridge 13 that includes a hole 15. Holes 16 may also be provided in flanges 11 to receive nails, screws or the like for connecting flanges 11 to a form.

Figure 6:
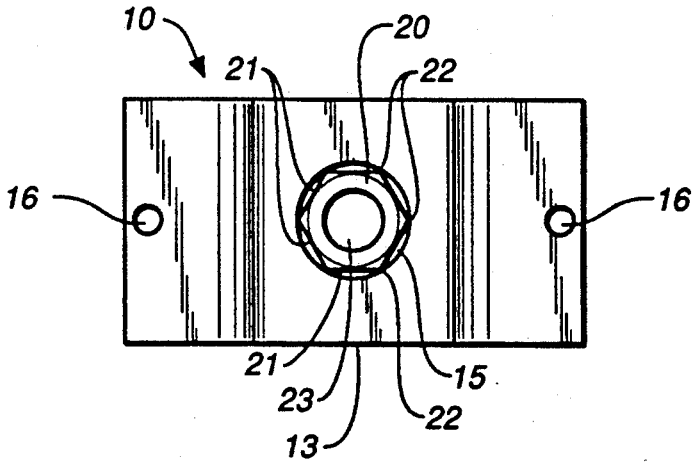
FIG. 6 is a partial bottom plan view of the insert of FIG. 1 with certain details enlarged.

An internally threaded coupling generally designated 20 is positioned between the two upstanding legs 12 and either within or directly below the hole 15. The internally threaded coupling 20 illustrated in the drawings has a hexagonal cross-section which includes flats 21 that intersect in lines 22. Couplings of this nature are available having the general character of an elongated nut. The coupling 20 has a threaded cavity 23 running through its entire length. Coupling 20 is positioned mostly below the bridge 13 as illustrated in FIG. 1 and between the legs 12. A bolt or the like, generally designated 25, is engaged with the threads of coupling 20. The bolt has a threaded portion 27 that extends to its end. The bolt is provided with a nut 28 and a washer 30, both positioned above the bridge of the U-shaped piece 10 as illustrated in FIG. 1. As best illustrated in FIG. 6, the intersections 22 are in frictional contact with the hole 15.

Figure 2:
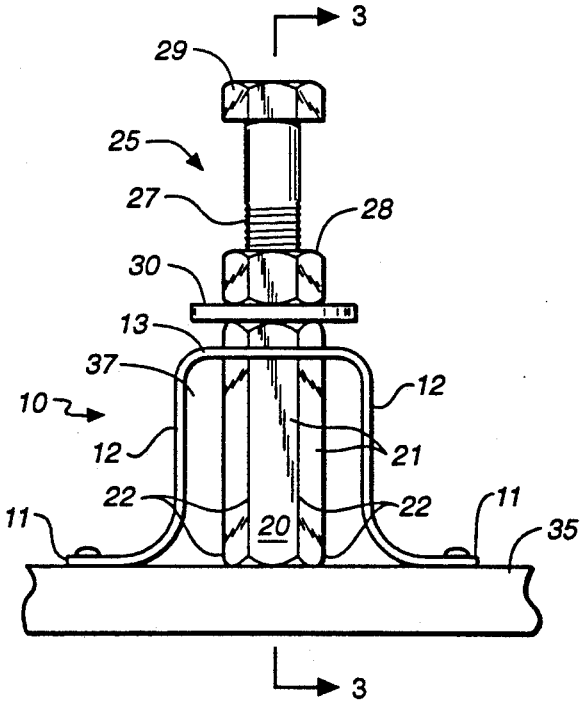
FIG. 2 is a front elevation view of the insert of FIG. 1 shown as it is used with a plywood form.

The illustrated insert is adaptable for use in many different construction techniques and it obviates the need for a contractor to keep an inventory of many different inserts for different uses or to adjust inserts for use with forms having prepunched holes. FIG. 2 illustrates a very common use for an insert. The insert shown in FIG. 2 is used with a plywood form upon which a concrete floor is poured. When the form is removed the concrete ceiling is exposed beneath the floor. The unit illustrated in FIG. 2 is installed on the form 35 which is a sheet of plywood placed to receive poured concrete. The insert is nailed or screwed to the plywood form 35 through holes 16 in feet 11 after which bolt head 29 is tapped with a hammer until the bottom of coupling 20 comes into contact with form 35. When concrete is poured it fills space 37 and surrounds the legs 12 and bridge 13 of the insert 10, as well as coupling 20 and bolt head 29. When the concrete hardens the insert is embedded and is unmovable so that it cannot be pulled out of the concrete and neither bolt 25 nor coupling 20 can rotate because the flats of both are encased in concrete. When the entire insert is embedded in concrete the strength of the material from which the U-shaped piece 10 is made is not a factor in supporting weight because the concrete supports any loads that are put on the insert.

Figure 3:
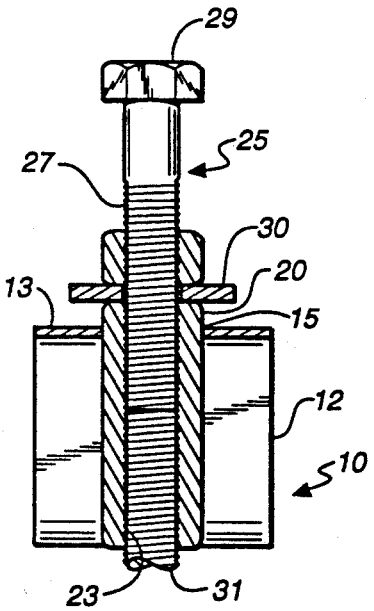
FIG. 3 is a cross-section taken along the plane of the line 3—3 of the insert illustrated in FIG. 2.

When the concrete hardens the form 35 is removed leaving a concrete ceiling with the threaded interior 23 (see FIG. 3) of the coupling 20 exposed. Plastic plugs are conventionally placed in the end of cavity 23 of the coupling to prevent concrete from entering it during pouring and hardening of the concrete. FIG. 3 illustrates that bolt 25 is screwed approximately halfway into threaded cavity 23 so that a threaded rod 31 can be screwed into the lower portion of the coupling 20 far enough to support the weight of a pipe and pipe hanger, or any other load to be suspended from a concrete ceiling.

Figure 4:
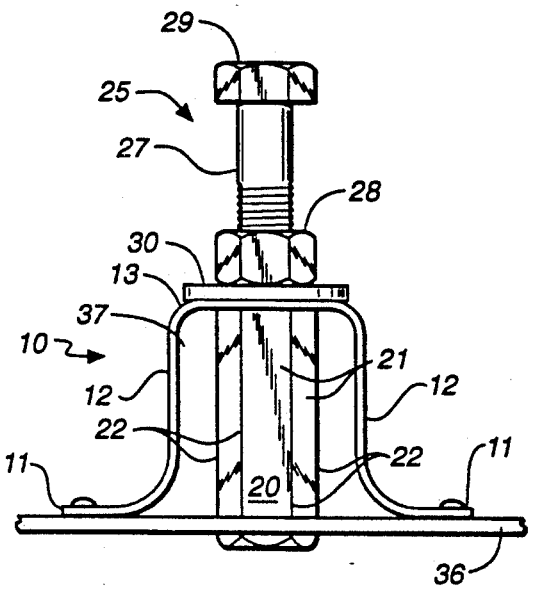
FIG. 4 is a front elevation view of the insert of FIG. 1 shown as it is used with a metal decking form.

FIG. 4 illustrates how the illustrated embodiment is used with a metal decking form. Metal decking used as a form is usually not removed after concrete hardens and remains as a permanent part of the structure. The coupling portion of the insert is placed in holes that are punched or drilled through the decking 36. The coupling 20 may be positioned so that its bottom is flush with the bottom surface of the metal decking 36 or it may be positioned to extend through the decking as illustrated in FIG. 4. When installing the illustrated insert on metal decking the nut 28 is positioned so that coupling 20 extends a preselected distance beyond feet 11, taking the thickness of washer 30 and the thickness of the metal decking 36 into account. For any given decking thickness the proper position of nut 28 may be measured only once with respect to the decking thickness and the desired degree of extension of coupling 20 past the bottom of decking 36, and all subsequent adjustments of the inserts can be quickly and easily determined by setting the same distance between nut 28 and bolt head 29 on other inserts to be used with the same decking.

Inserts can be installed by positioning U-shaped piece 10 to have coupling 20 superimposed over a hole in decking 36 positioned to receive coupling 20, and then tapping bolt head 29 with a hammer to drive coupling 20 through hole 15 until washer 28 contacts bridge 13. Feet 11 may be attached to the upper surface of decking 36 with any suitable means such as spot welds, adhesive, screws or the like. The attachment of feet 11 only needs to be strong enough to resist displacement of the insert by the force of the concrete pour because after concrete hardens the entire device is held in place by the surrounding concrete.

Figure 5:
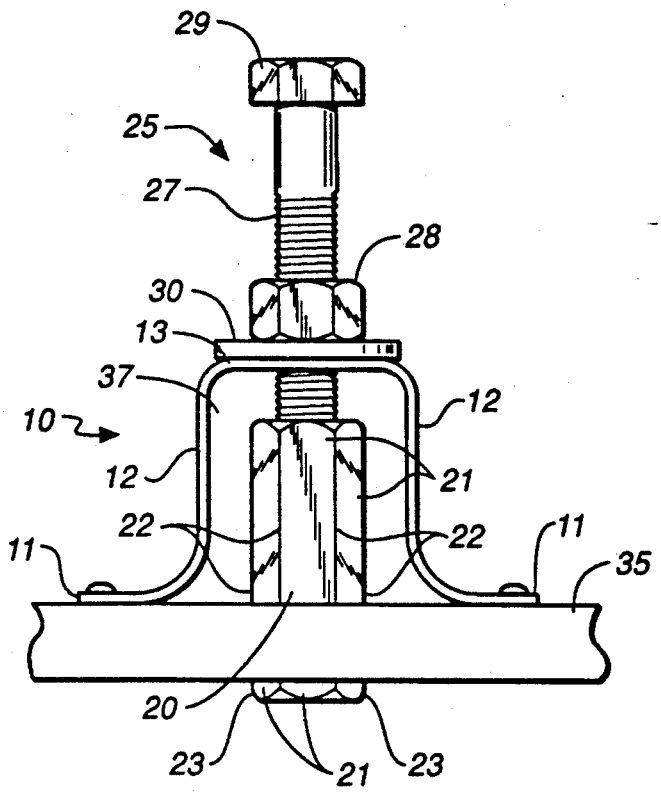
FIG. 5 is a front elevation view of the insert of FIG. 1 shown as an alternative use with a plywood form.

FIG. 5 illustrates how the insert of this invention may be used with plywood forms that are to remain in place after the concrete sets rather than being removed. The plywood form 35 is usually much thicker than metal decking so it is necessary for coupling 20 to extend farther through holes in the form that are drilled to receive it. The coupling may be flush with the bottom of the form or extend through it. FIG. 5 illustrates that the distance between nut 28 and bolt head 29 may be set so that coupling 20 can be completely below the hole 15 in the bridge 13 and held in place by friction with the hole in form 35 at the bottom and the position of nut 28 and washer 30 with respect to bridge 13 at the top. FIG. 5 illustrates that coupling 20 may be positioned to extend entirely through and beyond the lower surface of a thick, wooden form 35.

All of the illustrated embodiments use the same insert. Inserts of different sizes may be used for different anticipated loads but in such cases the size is dictated by the tensile strength of bolt 25 and coupling 20 as well as the depth of concrete under bolt head 29. In every case, the thickness of the concrete poured above the form will be greater than the maximum distance between feet 11 and bolt head 29. The insert of this invention may be used interchangeably with any type of form and any level of extension of the insert beneath the level of the ceiling.

If metal decking is used for the concrete form it will normally be in a standard size; a common size being 20 gauge. The metal decking also may have a cross-section in the form of a series of trapezoids and the insert of this invention may be positioned on either the upper or the lower horizontal side of the trapezoid. If plywood is used as a concrete form it also will normally be in a standard size such as ¾ inch. It is evident that the inserts of this invention as useful in any structure where items are to be connected to a poured concrete structure in pre-selected positions, and that the foregoing description is intended to describe a typical installation rather than being a limit on the scope of the invention.

I claim:

1. A concrete insert comprising a U-shaped support having two legs connected with a bridge, said legs terminating in lateral flanges which lie substantially in a plane.

an opening in said bridge, a coupling having connecting means, said coupling positioned between said legs, said coupling comprised of an external surface dimensioned to be in frictional engagement with said opening, an elongated connectable element engaged with said coupling, and a position-adjusting means on said connectable element, said position-adjusting means being movable axially on said connectable element and spanning the diameter of said opening.

2. The insert of claim 1 wherein said connecting means is internal threading, said connectable means includes external threads, and said position-adjusting means engages said external threads.

3. The insert of claim 1 wherein said position-adjusting means comprises a nut and a washer.

4. The insert of claim 1 wherein the end of said elongated element comprises a laterally expanded portion.

5. The insert of claim 1 wherein said coupling is at least as long as said legs.

6. The insert of claim 1 wherein said coupling has a regular polygonal cross-section dimensioned so that the intersections of the faces of said coupling will frictionally engage said opening.

* * * * *